US005570668A

United States Patent [19]

Hsu

[11] Patent Number: 5,570,668

[45] Date of Patent: Nov. 5, 1996

[54] LUBRICATING DEVICE OF AN ENGINE CYLINDER

[76] Inventor: Hsin-I Hsu, 10F-1, No. 58 Cheng Te Road, Section 3, Taipei, Taiwan

[21] Appl. No.: 578,981

[22] Filed: Dec. 27, 1995

[51] Int. Cl.[6] ..... F01M 11/08

[52] U.S. Cl. ..... 123/193.2; 123/196 M

[58] Field of Search ..... 123/193.2, 193.3, 123/193.5, 196 R, 196 M

[56] References Cited

U.S. PATENT DOCUMENTS

| | | | |
|---|---|---|---|
| 1,896,098 | 2/1933 | Poyer | 123/193.2 |
| 4,280,456 | 7/1981 | Klomp | 123/193.2 |
| 4,993,380 | 2/1991 | Hsu | 123/193.2 |
| 5,002,025 | 3/1991 | Crouse | 123/196 M |

*Primary Examiner*—Marguerite McMahon
*Attorney, Agent, or Firm*—Bacon & Thomas

[57] ABSTRACT

A cylinder block has a chamber communicating with a cylinder sleeve. The cylinder sleeve has spiral recesses on the outer periphery of the cylinder sleeve. Spaced through holes are on the spiral recesses. Oil-seepage holes are on the periphery of the oil pipe. The oil pipe coils around the cylinder sleeve along the spiral recesses. An oil-collecting groove is beneath the cylinder sleeve to communicate with an outlet pipe. An inlet pipe communicates with the upper end of the cylinder sleeve. The upper end of the oil pipe communicates with the inlet pipe.

1 Claim, 2 Drawing Sheets

LUBRICATING DEVICE OF AN ENGINE CYLINDER

BACKGROUND OF THE INVENTION

The invention relates to a lubricating device of an engine cylinder. More particularly, the invention relates to a lubricating device for a cylinder of a two-stroke engine.

The conventional engine mixes the fuel oil and the engine oil together. Some molecules of the fuel oil will be surrounded by the molecules of the engine oil. Thus the combustion of the fuel oil is not complete. The incomplete combustion of the fuel oil may cause air pollution and waste the fuel oil. Further, the lubrication of the inner periphery of the cylinder sleeve is not very efficient.

SUMMARY OF THE INVENTION

An object of the present invention is to provide a lubricating device of an engine cylinder which can lubricate the inner periphery of the cylinder sleeve efficiently.

Accordingly, a cylinder block has a chamber therein communicating with a cylinder sleeve in the cylinder block. The cylinder sleeve has a large number of spiral recesses formed on the outer periphery of the cylinder sleeve. A large number of spaced through holes are formed on the spiral recesses. An oil pipe has a large number of oil-seepage holes on the periphery of the oil pipe. The oil pipe coils around the outer periphery of the cylinder sleeve along the spiral recesses. An oil-collecting groove is disposed beneath the cylinder sleeve to communicate with an outlet pipe. An inlet pipe communicates with the upper end of the cylinder sleeve. The upper end of the oil pipe communicates with the inlet pipe.

DETAILED DESCRIPTION OF THE INVENTION

Figure 1:
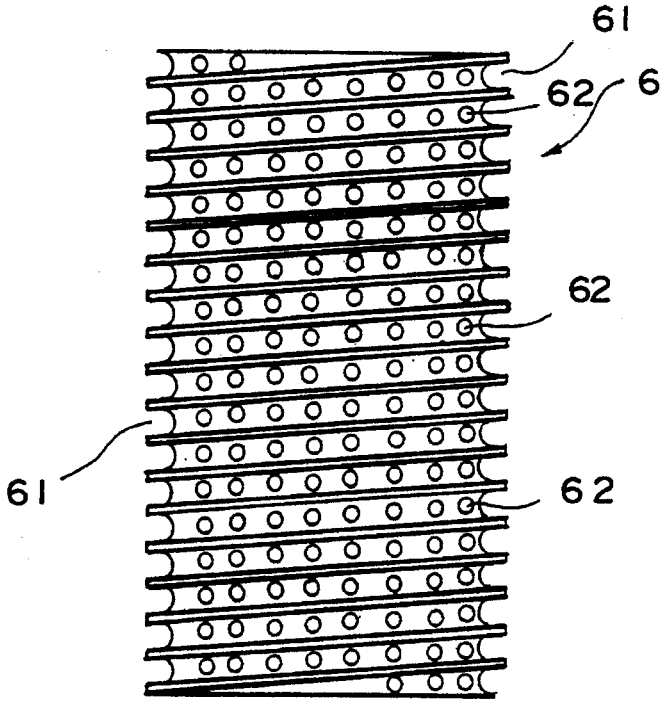
FIG. 1 is a side elevational view of a cylinder sleeve of a preferred embodiment.

Referring to FIG. 1, a cylinder sleeve 6 has a large number of spiral recesses 61 formed on the outer periphery of the cylinder sleeve 6. A large number of spaced through holes 62 are formed on the spiral recesses 61.

Figure 2:
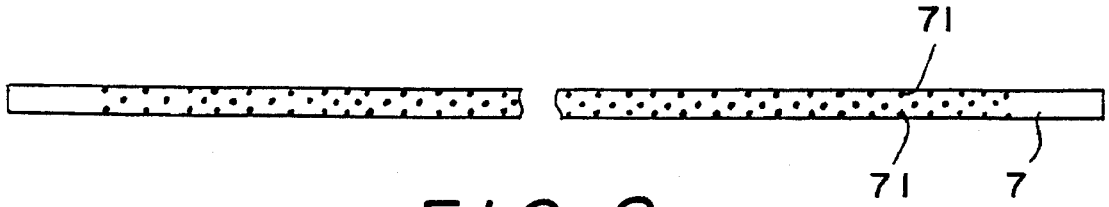
FIG. 2 is a side elevational view of an oil pipe.

Referring to FIG. 2, an oil pipe 7 has a large number of oil-seepage holes 71 on the periphery of the oil pipe 7.

Figure 3:
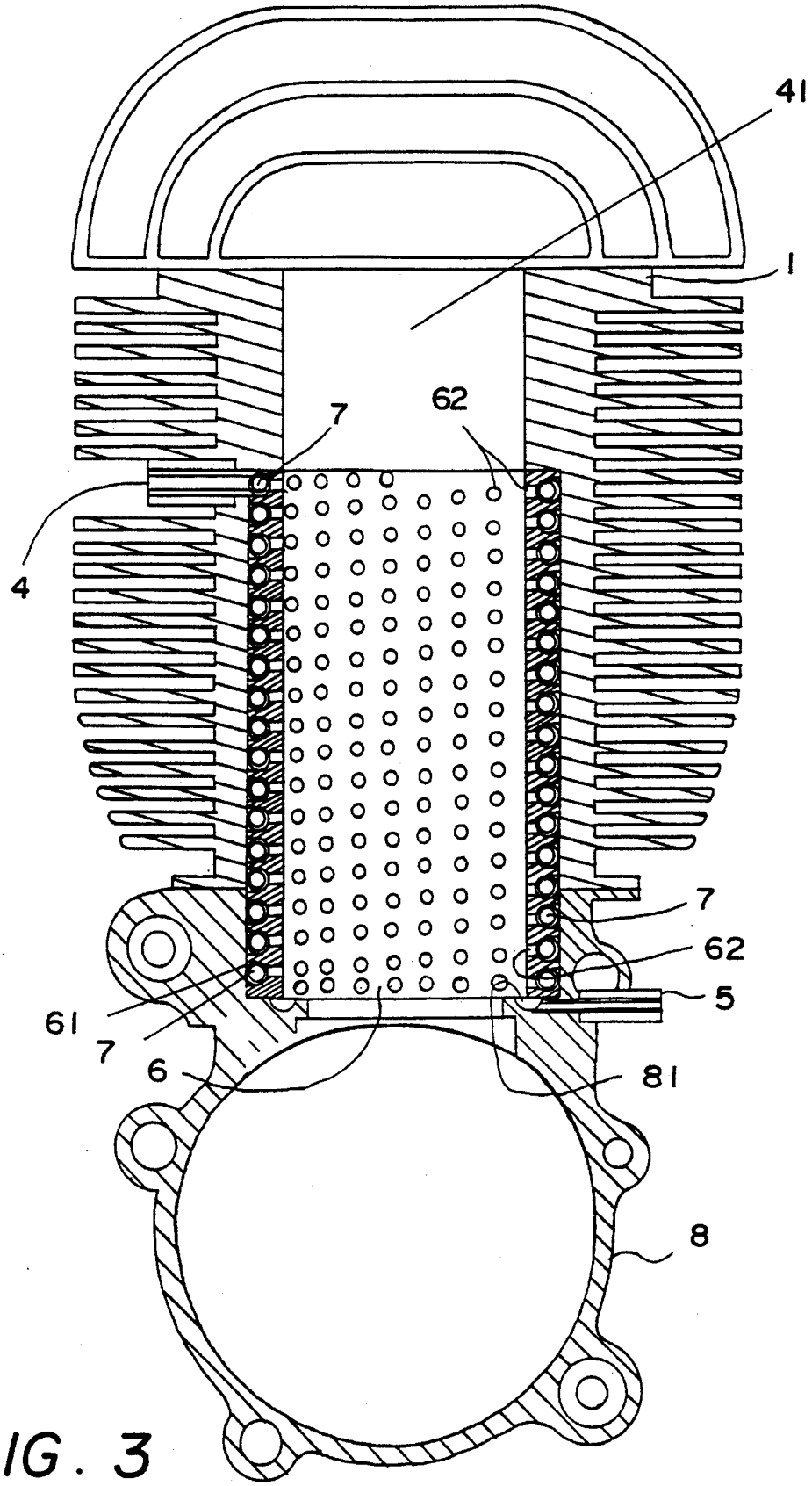
FIG. 3 is a partially cross-sectional view of a portion of an engine.

Referring to FIG. 3, a cylinder block 1 has a chamber 41 therein communicating with a cylinder sleeve 6 in the cylinder block 1. A cylinder seat 8 is disposed at the bottom of the cylinder block 1. An oil-collecting groove 81 is disposed beneath the cylinder sleeve 6 to communicate with an outlet pipe 5. An inlet pipe 4 communicates with the upper end of the cylinder sleeve 6. The oil pipe 7 coils around the outer periphery of the cylinder sleeve 6 along the spiral recesses 61. The upper end of the oil pipe 7 communicates with the inlet pipe 4.

Referring to FIGS. 1 to 3 again, the oil pipe 7 coils around the cylinder sleeve 6 along the spiral recesses 61. The cylinder sleeve 6 is placed in the cylinder block 1. Thus the oil pipe 7 is restrained between the cylinder block 1 and the spiral recesses 61 of the cylinder sleeve 6. Then the cylinder block 1 and the cylinder seat 8 are assembled together. The piston (not shown in the figures) which is in the cylinder block 1 can perform the expansion and compression cycle reciprocatively. The engine oil will enter the oil pipe 7 via the inlet pipe 4. Thus the engine oil will seep into the inner periphery of the cylinder sleeve 6 via the oil-seepage holes 71. The inner periphery of the cylinder sleeve 6 will be lubricated evenly. The residual engine oil will enter the oil-collecting groove 81 and enter the outlet pipe 5. Then the residual engine oil will move back to the circular system via the outlet pipe 5. Since the engine oil is confined in the cylinder sleeve 6, the engine oil will not mix with the fuel oil. Therefore, the molecules of the fuel oil will not be surrounded by the molecules of the engine oil. Thus the combustion of the fuel oil is complete.

The invention is not limited to the above embodiment but various modification thereof may be made. It will be understood by those skilled in the art that various changes in form and detail may be made without departing from the scope of the invention.

I claim:

1. A cylinder block comprising:

a chamber therein communicating with a cylinder sleeve in said cylinder block;

said cylinder sleeve having a large number of spiral recesses formed on an outer periphery of said cylinder sleeve;

a large number of spaced through holes formed on said spiral recesses;

an oil pipe having a large number of oil-seepage holes on a periphery of said oil pipe;

said oil pipe coiling around said outer periphery of said cylinder sleeve along said spiral recesses;

an oil-collecting groove disposed beneath said cylinder sleeve to communicate with an outlet pipe;

an inlet pipe communicating with an upper end of said cylinder sleeve; and an upper end of said oil pipe communicating with said inlet pipe.

* * * * *